US005871173A

United States Patent [19]

Frank et al.

[11] Patent Number: 5,871,173

[45] Date of Patent: Feb. 16, 1999

[54] DRAG-PRODUCING AERODYNAMIC DEVICE

[75] Inventors: Stephen J Frank, Buckingham; David Hawkins, Radlett, both of United Kingdom

[73] Assignee: GEC-Marconi Limited, United Kingdom

[21] Appl. No.: 730,376

[22] Filed: Oct. 15, 1996

[30] Foreign Application Priority Data

Oct. 13, 1995 [GB] United Kingdom ..... 9521045

[51] Int. Cl.[6] ..... F42B 10/14

[52] U.S. Cl. ..... 244/1 TD; 244/138 R; 244/327; 244/113

[58] Field of Search ..... 244/3.27, 3.29, 244/113, 110 D, 138 R, 135 A; 102/385, 386, 388

[56] References Cited

U.S. PATENT DOCUMENTS

| | | | |
|---|---|---|---|
| 21,219 | 8/1858 | Sibley | 244/3.28 |
| 1,537,713 | 5/1925 | Sperry et al. | 102/384 |
| 2,960,291 | 11/1960 | Patterson | 244/113 |
| 2,998,949 | 9/1961 | Patterson | 211/113 |
| 3,047,259 | 7/1962 | Tatnall et al. | 244/138 R |
| 3,048,357 | 8/1962 | Loedding | 244/135 |
| 3,943,483 | 3/1976 | Strange | 114/235 |
| 3,978,790 | 9/1976 | Sandelius | 244/138 R |
| 4,007,505 | 2/1977 | Nowatzki | 340/2 |
| 4,870,904 | 10/1989 | Picot | 102/386 |
| 5,029,773 | 7/1991 | Lecat | 244/3.24 |
| 5,255,877 | 10/1993 | Lindgren et al. | 244/135 A |
| 5,413,514 | 5/1995 | Milligan | 244/138 R |
| 5,427,333 | 6/1995 | Kirkland | 244/135 A |

FOREIGN PATENT DOCUMENTS

| | | |
|---|---|---|
| 26 13 953 | 4/1976 | Germany . |
| 219034 | 7/1924 | United Kingdom . |
| 485750 | 5/1938 | United Kingdom . |
| 603990 | 6/1948 | United Kingdom . |
| 782788 | 9/1957 | United Kingdom . |
| 1 527 388 | 10/1978 | United Kingdom . |

*Primary Examiner*—Lissi Mojica
*Attorney, Agent, or Firm*—Kirschstein, et al.

[57] ABSTRACT

It is known to use a rigid cone to provide stability to a body being towed by an aircraft. However, such cones are useful over a limited range of speeds. The invention provides a drag-producing aerodynamic device in which the cross-sectional area of the structure producing drag is variable. The cross-sectional area of the structure producing drag decreases as the towing speed, and hence the dynamic air pressure acting on the structure producing drag, increases and vice versa.

12 Claims, 2 Drawing Sheets

DRAG-PRODUCING AERODYNAMIC DEVICE

BACKGROUND OF THE INVENTION

Such devices are used to provide stability to a body being towed e.g. by an aircraft in flight. It is known to use a rigid cone for such a purpose. However, a cone of small diameter, which is suitable for stabilizing a body being towed at high speed, is not ideally suited to low speed towing as it does not provide sufficient drag to stabilize the towed body against disturbances caused by induced oscillations propagated down the towing cable. Equally, a cone of large diameter which is suitable for the latter situation, can cause too much drag at high speed, which can place excessive strain on the towing cable.

SUMMARY OF THE INVENTION

The invention provides a drag-producing aerodynamic device for providing stability to a towed body, the device comprising a plurality of drag-producing blades pivotable at one end portion, the other end portions lying on a circle, the diameter of which is arranged to reduce, as the drag increases, against the force of resilient means via the intermediary of a sleeve moveable normal to the circle.

The cross-sectional area defined by the drag-producing blades is variable, which enables the device to produce the optimum amount of drag for the circumstances of towing. Furthermore, when in storage, the device occupies minimum volume and thus the storage container can be made smaller than was necessary for rigid cones.

The resilient means is advantageously provided by a helical spring. The sleeve preferably surrounds the main tubular body of the device which is attached to the towed body. A ring may be provided, mounted on and coaxially with the main tubular body of the device. This ring permits the means which pivotably fix the blades to the sleeve to act as cams for the blades. Means may also be provided to restrict the movement of the sleeve to linear motion between predetermined limits.

The blades may be laid forward, flat against the sleeve for storage purposes. Some, preferably half of the blades may be contoured so that when an airstream moves from the free end to the fixed end of each blade when in the latter position, the specially contoured blades will tend to lift. This feature enables the blades to pivot into a conical shape for producing drag.

BRIEF DESCRIPTION OF THE DRAWINGS

The invention will now be described by way of example, with reference to the accompanying drawings, in which.

DETAILED DESCRIPTION OF THE PREFERRED EMBODIMENTS

Figure 1B:
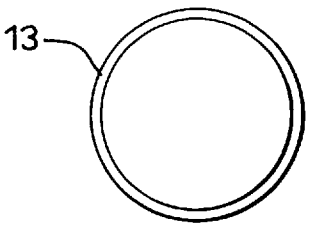
FIG. 1*b* is a rear view of the aerodynamic device of FIG. 1*a;*
Figure 1A:
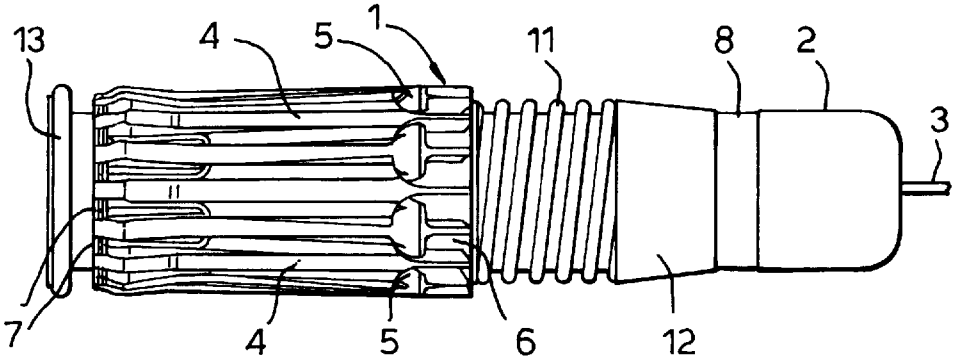
FIG. 1*a* is a side view of a towed body and drag-producing aerodynamic device when in a position suitable for storage.

Referring to FIG. 1*a,* the drag-producing aerodynamic device, indicated generally by the reference numeral 1, is attached to the body 2 which is to be towed. Towing cable 3 connects body 2 to the towing aircraft (not shown). The point of attachment of towing cable 3 to body 2 is not restricted to that shown in the drawings.

The drag-producing structure of the aerodynamic device 11 incorporates two kinds of blades, 4 and 5. Blades 4 are alternately mounted with blades 5 around the circumference of a slidable sleeve 6 such that blades 4 lie outermost. The blades, 4 and 5, are pivotably attached at one end portion to the slidable sleeve by hinge means 7. Sleeve 6 is mounted coaxially to the main tubular body 8 of the device and can slide axially relative to body 8. Sleeve 6 is constrained to move between limits imposed by lugs 9 attached to the main tubular body 8 of the device, and which lie in slots 10 in the sleeve 6. This arrangement, shown in FIG. 2*a,* also prevents rotation of the sleeve 6 about body 8. The sleeve 6 rests against resilient means in the form of a helical spring 11, the other end of which rests against collar 12. Ring 13 is securely mounted onto the tubular body 8. The volume occupied by this configuration is a minimum for this particular towed body 2 and aerodynamic device 1, and so this configuration is suitable for storage of the body and device.

Figure 2B:
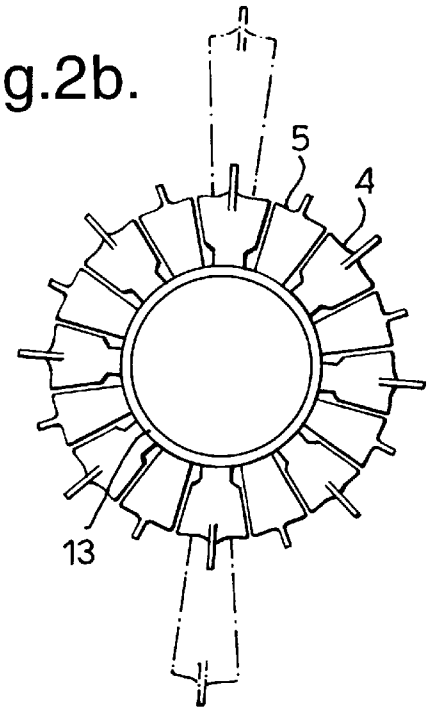
FIG. 2*b* is a rear view of the aerodynamic device of FIG. 2*a.*
Figure 2A:
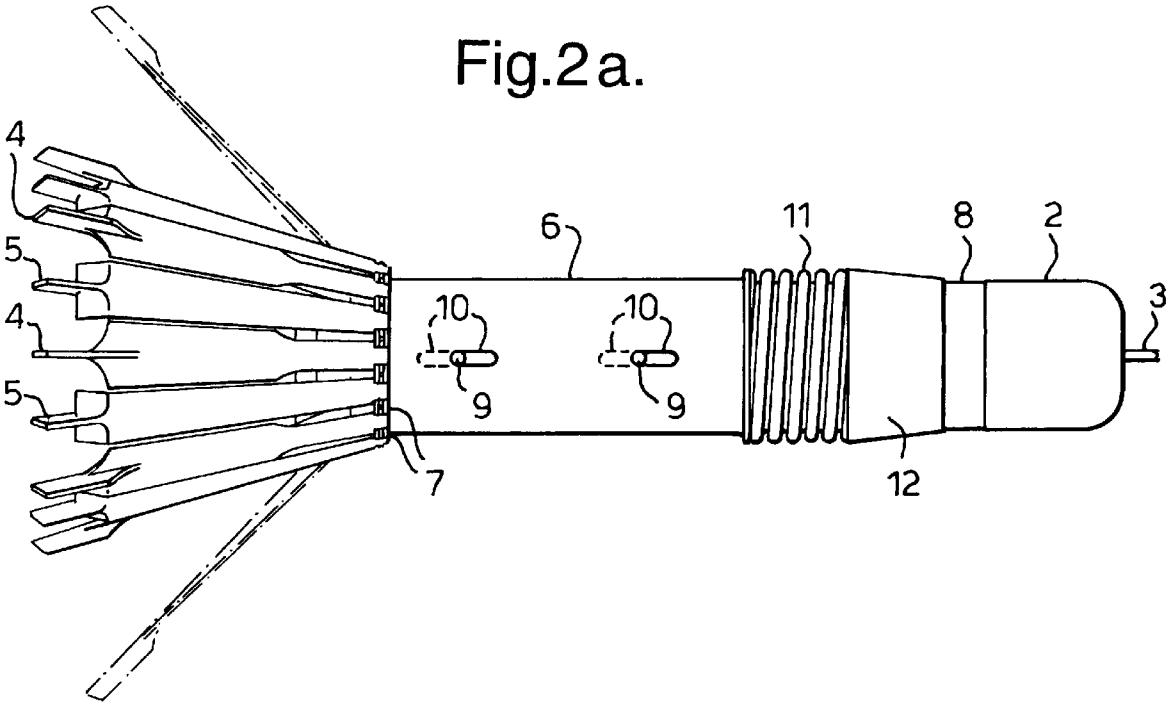
FIG. 2*a* is a side view of the towed body and aerodynamic device when being towed.

When in storage, the towed body 2 and device 1 are kept inside a storage container (not shown) until the pilot of the towing aircraft releases them from the container by e.g. pressing a button in the cockpit. The towed body 2 and device 1 emerge from the storage container backwards i.e. ring 13 emerges first. The design of blades 5 is such that, on release of the body and aerodynamic device, the airstream moving under these blades exerts pressure on the underside of each blade sufficient to lift each free end portion. Consequently, blades 4 are raised by blades 5. The blades 4 and 5 pivot about their points of attachment on sleeve 6 until they turn over and the blades come into contact with ring 13, as illustrated in FIG. 2*b.* The blades shown by broken lines in FIGS. 2*a* and 2*b* represent the position of the blades when the dynamic air pressure acting on the aerodynamic device 1 is at or below a known minimum, such as happens when the towing aircraft is travelling at low speed. In this configuration, the sleeve 6 is in substantially the same position on the main body 8 of the device as it is in FIG. 1*a,* and each lug 9 rests against one end of its slot 10, as shown by broken lines. The blades define a substantially conical shape which provides the maximum possible cross-sectional area for producing drag. Thus, at low air speeds, the drag-producing aerodynamic device produces maximum available drag.

If the air pressure acting on the blades increases, such as happens when the towing aircraft increases speed, the additional pressure produces a turning moment which acts on the free end portion of each blade, which therefore tries to pivot about its point of contact on ring 13. However, the other end portions of the blades are connected to the sleeve 6, and so these end portions are constrained to move linearly with the sleeve. Thus, a pressure increase causes the sleeve to move against the spring 11 and, as the blades 4 and 5 maintain contact with ring 13, the free end portions of the blades define a circle of smaller diameter. The blades occupy an equilibrium position, as shown by the solid lines of FIG. 2*a,* where the turning moment caused by air pressure acting on the free end portions of the blades is equal and opposite to the turning moment acting on the other end portions, caused by the restoring force of compressed spring 11 acting on sleeve 6. Thus, as shown in FIG. 2*b,* an increase in speed causes a reduction in the cross-sectional area producing drag. In fact, in this drawing, the blades shown in solid lines define a minimum cross-sectional area producing drag and form an almost continuous conical surface. The sleeve is restrained from moving further forward by lugs 9 which abut the other end of respective slots 10.

If the towing aircraft then decreases speed, the air pressure acting on the blades decreases. The restoring force produced by the compressed spring 12 tends to move sleeve 6 backwards towards ring 13. As the sleeve moves, the blades define a circle of increasing diameter thereby increasing the cross-sectional area producing drag until equilibrium is achieved once more.

There are a number of variable parameters associated with the drag-producing aerodynamic device. Such parameters include the size and shape of the blades, the diameter of the ring, the length of the slot on the sleeve and the spring constant of the helical spring. Each parameter may be adjusted to suit the performance of the particular towing aircraft.

Suitable material for the manufacture of the blades is polycarbonate material. The ring may be manufactured from poly-tetra-fluoroethylene (PTFE). The sleeve and tubular body may be made of aluminium and the helical spring may be steel.

Variations may be made without department from the scope of the invention. For instance, materials other than those mentioned above may be used. The invention need not be used by aircraft, as underwater towing by submarines may be possible.

We claim:

1. An aerodynamic device for producing a variable drag during towing to provide stability to a towed body, said device comprising:

a) a sleeve extending along a longitudinal axis and mounted on the body for longitudinal movement along said axis;

b) resilient means mounted on the body and resiliently bearing against, and resiliently resisting the longitudinal movement of, the sleeve with a restoring force; and c) a plurality of drag-producing blades having a first set of end portions pivotably mounted on the sleeve and arranged about said axis, and a second set of free end portions arranged about a circular locus whose diameter changes uniformly and symmetrically in response to a variable pressure exerted on said free end portions during towing, said blades being operative in unison to move the sleeve to an equilibrium position in which the pressure exerted on said free end portions counterbalances the restoring force of the resilient means.

2. The device as claimed in claim 1, wherein the sleeve is slidably mounted on the body.

3. The device as claimed in claim 1, wherein the resilient means is a compression spring.

4. The device as claimed in claim 3, wherein the spring is a helical coil.

5. The device as claimed in claim 3, and further comprising a fixed collar on the body, and wherein the spring has opposite ends respectively engaging the collar and the sleeve.

6. The device as claimed in claim 1; and further comprising means for limiting the longitudinal movement of the sleeve.

7. The device as claimed in claim 6, wherein the limiting means includes a longitudinal slot formed in the sleeve, and a stop pin fixed to the body and received in the slot.

8. The device as claimed in claim 1, wherein the circular locus has a center on the longitudinal axis, and wherein the blades are symmetrically arranged about said axis.

9. The device as claimed in claim 1; and further comprising a ring fixed to the body, said blades bearing against the ring at intermediate portions located between the first and second sets of end portions during towing, said ring acting as a bearing surface against which the sleeve is moved by the blades.

10. The device as claimed in claim 1, wherein the blades are movable from a storage position in which the blades bound a generally cylindrical volume and lie coaxially adjacent the sleeve, to a towed position in which the blades bound a generally conical volume that diverges along said axis in a direction away from the sleeve.

11. The device as claimed in claim 10; and further comprising a plurality of contoured lift blades alternately arranged with said drag-producing blades around said axis, said lift blades being located underneath the drag-producing blades to raise the drag-producing blades during towing to said towed position.

12. The device as claimed in claim 1, wherein the blades are constituted of a polycarbonate material.

* * * * *